US006945887B2

(12) United States Patent
Oister et al.

(10) Patent No.: US 6,945,887 B2
(45) Date of Patent: Sep. 20, 2005

(54) GAME BALL WITH CLOCK

(75) Inventors: Michael J. Oister, Superior, CO (US); Christopher S. Wisener, Westminster, CO (US); William C. Boettcher, Denver, CO (US); Thomas M. Doherty, Denver, CO (US)

(73) Assignee: Classic Sport Companies, Inc., Westminster, CO (US)

( * ) Notice: Subject to any disclaimer, the term of this patent is extended or adjusted under 35 U.S.C. 154(b) by 309 days.

(21) Appl. No.: 10/014,297

(22) Filed: Dec. 11, 2001

(65) Prior Publication Data

US 2003/0109338 A1 Jun. 12, 2003

(51) Int. Cl.[7] ..... A67B 67/00
(52) U.S. Cl. ..... 473/570; 473/571
(58) Field of Search ..... 473/570, 571; 119/707; 368/10; 439/577

(56) References Cited

U.S. PATENT DOCUMENTS 4,577,865 A 3/1986 Shishido
4,775,948 A * 10/1988 Dial et al. ..... 702/149
4,872,854 A * 10/1989 Hesu ..... 439/577
5,288,069 A 2/1994 Matsumoto
5,375,839 A 12/1994 Pagani
5,445,375 A 8/1995 Sweeny
5,468,000 A * 11/1995 Bennett ..... 473/570
5,526,326 A * 6/1996 Fekete et al. ..... 368/10
5,779,576 A * 7/1998 Smith et al. ..... 473/570
5,810,685 A * 9/1998 Willner et al. ..... 473/571
5,912,864 A * 6/1999 Maurer ..... 368/10
6,117,031 A * 9/2000 Malinauskas et al. ..... 473/570
6,578,527 B1 * 6/2003 Mathers ..... 119/707

OTHER PUBLICATIONS

Innoland, Inc., Lightning Strike Sound and Light Soccer, unknown, pictures attached.

* cited by examiner

*Primary Examiner*—Kien Nguyen
(74) *Attorney, Agent, or Firm*—Holland & Hart LLP

(57) ABSTRACT

The present invention includes ball having integrated timers for measuring or counting at least one time period.

20 Claims, 3 Drawing Sheets

GAME BALL WITH CLOCK

FIELD OF THE INVENTION

The present invention relates to game balls and, more particularly, recreational sport balls having clocks or timers.

BACKGROUND OF THE INVENTION

In many sports activities, timing or counts can be important. For example, in a professional basketball game, officials have a shot clock that provides a specific amount of time for the offensive team to take a shot. In recreational basketball games, often times participants wish to simulate the shot clock. Similarly, in recreational football games, often a "pass rusher" counts off a number of seconds prior to rushing the passer to simulate the time a professional quarterback would have to stand in, for example, the pocket prior to throwing a pass.

In some case, such as the basketball shot clock, timers can be used off the court. Alternatively, the basketball hoop can be modified to incorporate a timer that resets after each basket. However, even simple timers require equipment to be attached to the basket or carried from court to court This is difficult as conventional timers are relatively non-portable. Thus, it would be desirous to provide a ball with a clock or timer to perform these and other functions of timers.

SUMMARY OF THE INVENTION

The foregoing and other features, utilities and advantages of the invention will be apparent from the following more particular description of a preferred embodiment of the invention as illustrated in the accompanying drawings. Further, the advantages and purpose of the invention will be realized and attained by means of the elements and combinations particularly pointed out in the appended claims.

To attain the advantages and in accordance with the purpose of the invention, as embodied and broadly described herein, balls having a timer integrated into the ball are provided. The balls also have a sound generator. The timer is capable of measuring at least one time period and the sound generator can provide a sound indicating the end of the at least one time period.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Figure 1:
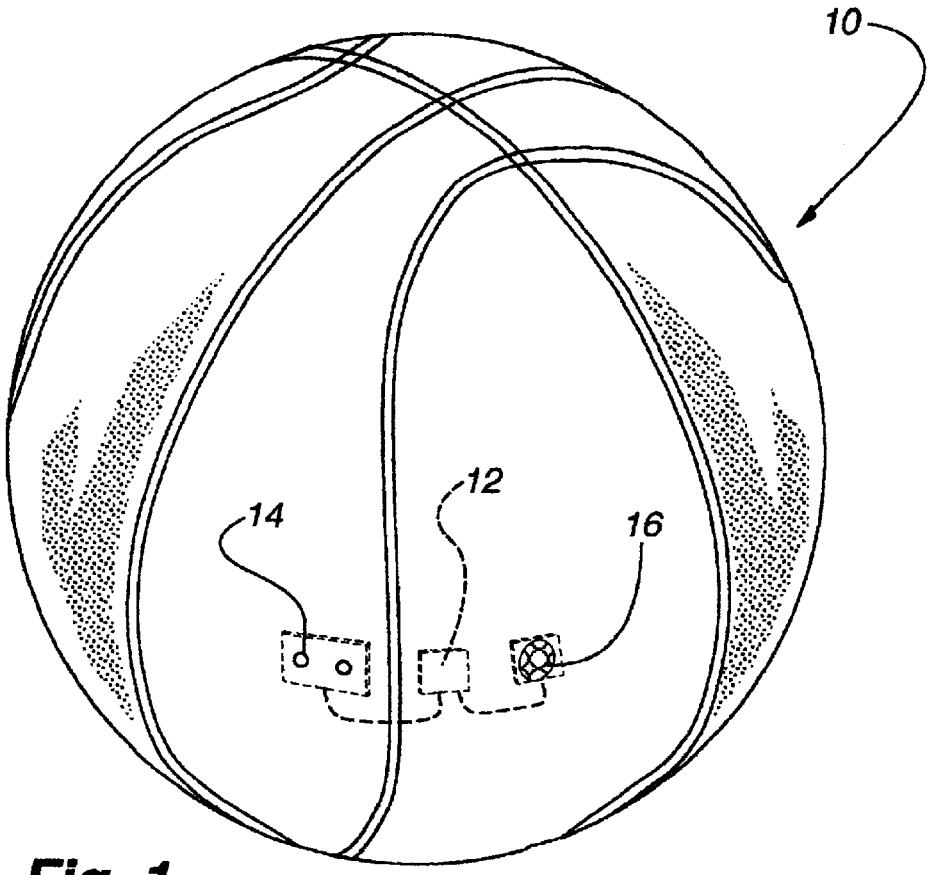
FIG. 1 shows a game ball having a timer in accordance with a possible embodiment of the present invention.
Figure 2:
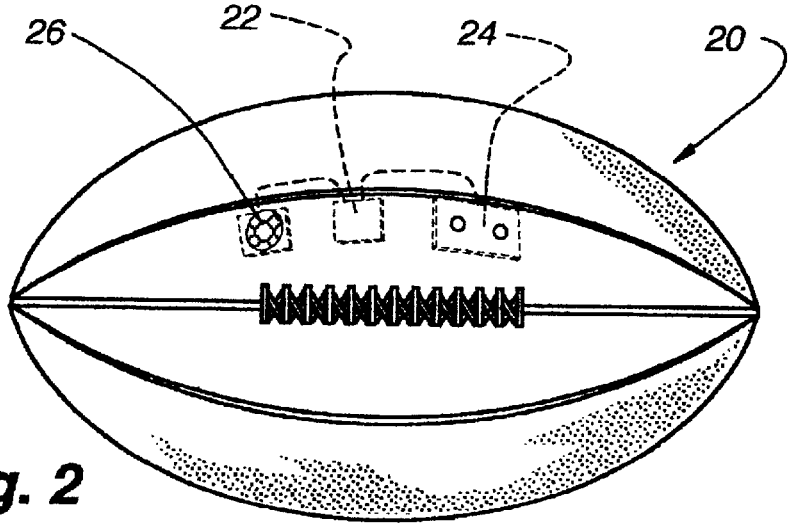
FIG. 2 shows another game ball having a timer in accordance with a possible embodiment of the present invention.

Some embodiments of the present invention are described with reference to FIGS. 1 and 2. In particular, FIG. 1 shows a basketball 10 having a timer 12, a control panel 14, and a sound generator 16. Not specifically shown, basketball 10 would also have a power source, which could be any conventional power source, such as, for example, conventional double A or triple A batteries. Basketball 10 can be any type of basketball, such as, for example, a NBA regulation basketball, other conventional basketballs, or other basketballs, such as a foam ball (like a NERF® ball), synthetic leather balls, plastic balls, etc. Timer 12 could be a conventional clock circuit, a microprocessor, a microchip, or other type of device capable of measuring time or counts. Control panel 14 could be simply a reset device for the timer to reset the timer for the next period. However, control panel 14, which will be explained in more detail below, is not necessary. Sound generator 16 could be a microprocessor, microchip, or other device capable of generating sound. Generally, sound generator 16 would have a speaker (not specifically shown) associated with it that could be mounted on the control panel 14 or elsewhere on the ball. Further, sound generator could be more complex, such as a voice synthesizer, or less complex, such as a buzzer. Also, while timer 12 and sound generator 16 are shown separately for convenience, they could be combined into a single unit. Similarly, FIG. 2 shows a football 20 having a timer 22, a control panel 24, and a sound generator 26. While the present invention is shown incorporated into a basketball and football, one of ordinary skill in the art on reading the disclosure would understand that other balls could be used.

In operation, a player would reset the timer 12, which will be further explained in conjunction with the control panel description below, at the start of the desired count period. The timer 12 would begin counting, in this case, seconds until the shot clock period expires. At the end of the time period, the timer would send a signal to sound generator 16 that would generate a sound, such as a buzzer, indicating the end of the period. In more complex arrangements, the timer 12 could send a signal to sound generator 16 that causes sound generator 16 to make audible all or some portion of the countdown period, i.e., sound generator 16 could produce a 10, 9, 8, . . . countdown to the end of the period. The count down could be a voice synthesis countdown or simply clicks that start at the 10 second point (or some other point such as 5 second). Moreover, the countdown could be a combination of clicks or voice synthesis, such as a verbal 10, 9, 8 . . . and a buzzer at zero.

After the count period, if the game ball has a control panel, the player can reset the timer 12 to being the next period. Alternatively, the timer could simply being the next period after the end of the previous period without need for a reset. If the timer 12 did not get reset, but rather started counting the next period at the end of the pervious period, the entire control panel could be eliminated if desired. Instead of a manual reset on a control panel, a reset device could be mounted in, for example, the basketball hoop that would automatically reset the timer 12 when the basketball comes within a predetermined distance of the reset device. Alternatively, a remote control style device could be used to reset the timer 12. Also, the timer 12 could be voice activated by commands such as, for example, start, stop, shot, etc. to start, stop, or even pause the timer period. If voice actuation is employed, it may be desirous to use a microphone, which could be mounted on the control panel or elsewhere.

Figure 3:
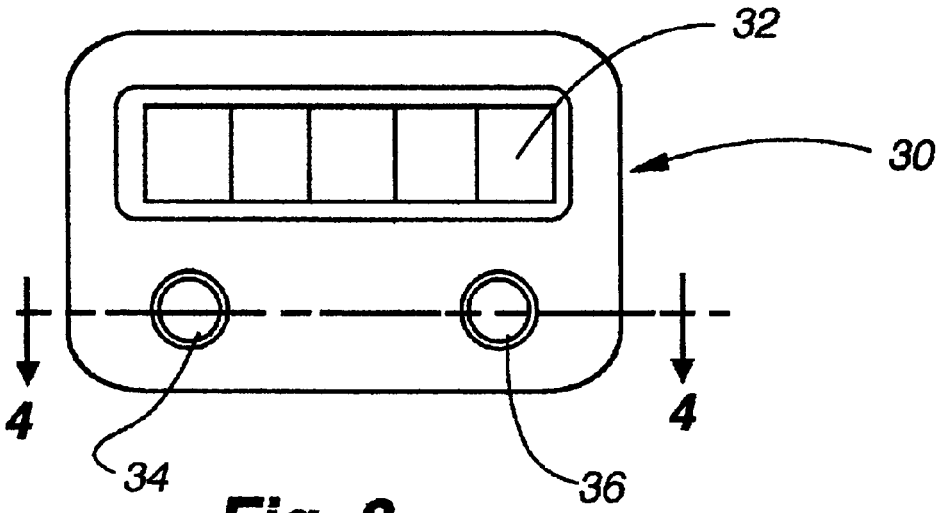
FIG. 3 shows a possible control panel 30 in accordance with the present invention.

FIG. 3 shows a possible control panel 30 for timer or clock. As explained above, the features of control panel 30 are not necessary for the present invention. Generally, control panel 30 may have a reset 34 and a count period select 36. Control panel 30 may also have a display 32 If a display is used, the display could receive a signal from the time to display the current time, the time period select length (i.e, 24 second shot clock, 5 second rush count, etc.) Also, depending on the application, the display may be configured to count up or down with the timer.

Figure 4A:
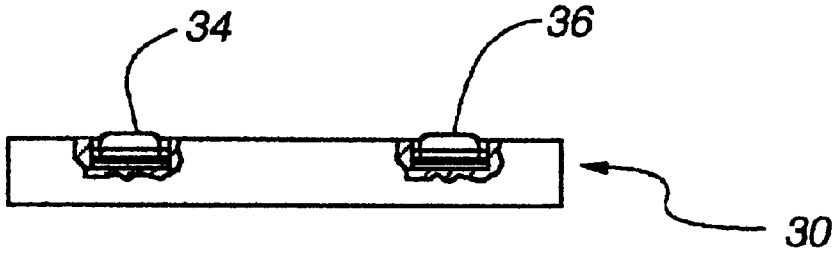
FIGS. 4A and 4B show possible cross-sectional views of control panel 30.
Figure 4B:
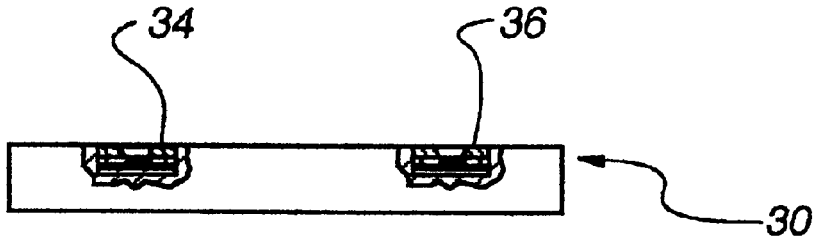

As shown in FIGS. 4A and 4B, the reset 34 and count period select 36 could either be raised or depressed. In order to inhibit inadvertent resets and/or count period selections, a protective cover could be implemented (not shown) to cover the reset 34 and count period select 36. In this case, actuating reset 34 would reset the timer 12 to the beginning of the count period. Similarly, actuating count period select 36 would cycle through the available choices in the count period. For example, the count period could be originally set for 24 seconds, but include options for count periods of 30, 32, and 15 seconds (notice the period length is arbitrary and a matter of design or customer choice). Actuating count period select 36 could cycle the count period between the various choices. In other words, the first time count period select 36 is actuated, the count period would change from 24 seconds to 30 seconds, the second time to 32 seconds, the third time to 15 seconds and the fourth time back to 24 seconds, etc. A display 32 would facilitate the selection by displaying the count period length on the display each time the count period select 36 is actuated.

Figure 5:
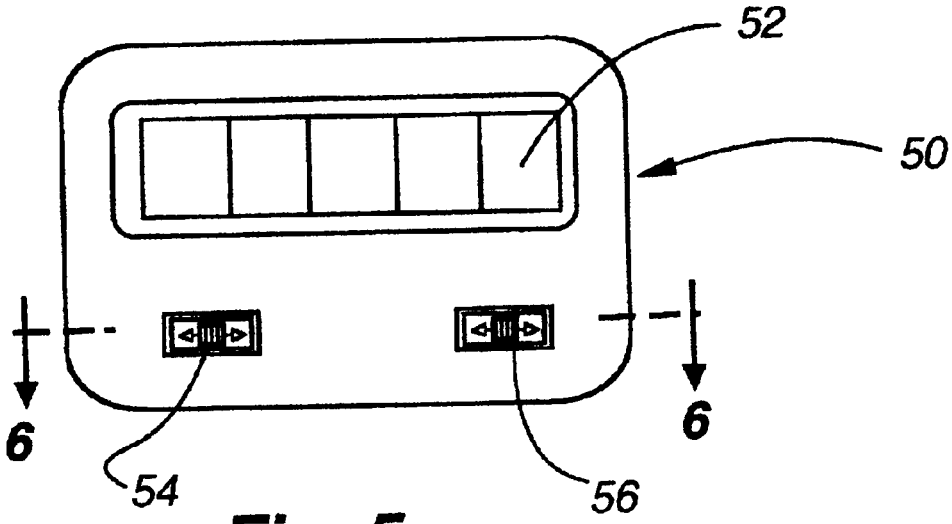
FIG. 5 shows another possible control panel 50 in accordance with the present invention.
Figure 6A:
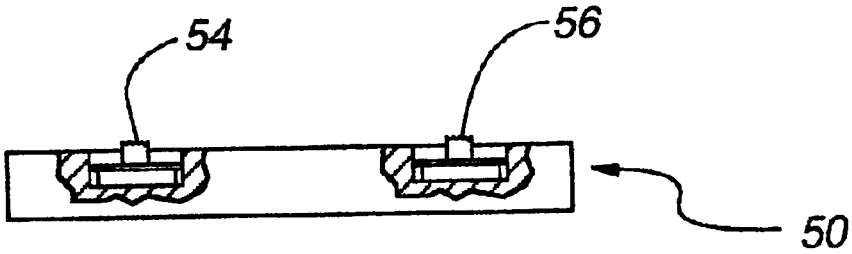
FIGS. 6A and 6B show possible cross-sectional views of control panel 50.
Figure 6B:
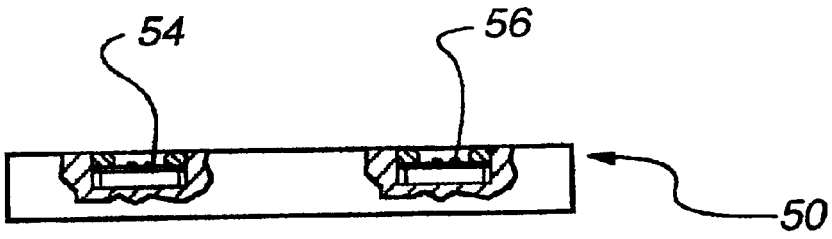

FIG. 5 shows another possible control panel 50. Control panel 50 has a display 52, a reset 54, and a count period select 56. In this case, reset 54 and count period select 56 have more of a slide actuation than a press actuation. One advantage of the slide actuation is that the count period select 56 could have predefined spots on the slide to select time periods instead of cycling through time periods. In other words, count period select 56 could have 5 predefined positions for time period, such as, a first position for 15 seconds, a second position for 24 seconds, etc. As one of ordinary skill in the art would recognize on reading the disclosure, resets 34 and 54 and count period selects 36 and 56 could be any style of actuator. Moreover, resets and count period selects could be the same or different types of actuators.

The above reset and count period select controls are described in relation to simply single action style actuators or switches with multiple presets It would be possible to incorporate a keyboard into the control panels. The keyboard could be a conventional alpha, numeric or alphanumeric keyboard.

As one of skill in the art would recognize on reading this disclosure, while the timers 12 and 22, and sound generators 16 and 26 are shown mounted internal to the balls 10 and 20, they could be mounted on the surface of the balls. Moreover, the timers and sound generators could be incorporated into the control panel. Alternatively, the control panels 14 and 24 could be removed and the timers 12 and 22, and sound generators 16 and 26 could mounted on the surface or internal to the balls 10 and 20.

If a control panel is not used, timers 12 and 22 and sound generators 16 and 26 could be preset to particular counts periods and sounds. Alternatively, a receiver (not shown) could be incorporated into the balls to receive control signals from a remote control device The remote control device would operate similar to the control panels 30 and 50 discussed above. The timers and sound generators could also respond to proximity signals (such as a reset for the shot clock when the shot is close to the basket), or motion detectors (such as the pass rush counting beginning on the snap motion). In other words, many types of control schemes are possible using the present invention, but only a few illustrative examples are given.

While the invention has been particularly shown and described with reference to some embodiment thereof, it will be understood by those skilled in the art that various other changes in the form and details may be made without departing from the spirit and scope of the invention.

We claim:

1. An apparatus, comprising:

a ball;

at least one timer integrated with the ball for measuring at least one predetermined time period;

at least one sound generator integrated with the ball; and the at least one sound generator for producing at least one sound based on the at least one predetermined time period, and wherein the least one sound generator produces the at least one sound at the end of the at least one predetermined time period.

2. The apparatus according to claim 1, wherein:

the at least one timer is mounted on the surface of the ball.

3. The apparatus according to claim 2, wherein:

the at least one sound generator is mounted on the surface of the ball.

4. The apparatus according to claim 1, comprising a reset.

5. The apparatus according to claim 1, comprising a display mounted on the surface of the ball.

6. The apparatus according to claim 1, comprising:

at least one control panel;

the at least one control panel, comprising:

at least one reset; and at least one count period select.

7. The apparatus according to claim 6, wherein at least one of the at least control panels has at least one display.

8. The apparatus according to claim 6, wherein the at least one reset is a push button.

9. The apparatus according to claim 8, comprising a cover panel.

10. The apparatus according to claim 1, comprising:

a receiver integrated with the ball; and at least one remote control capable of sending signals to the receiver.

11. The apparatus according to claim 10, wherein the at least one remote control sends at least a reset signal.

12. The apparatus according to claim 11, wherein the at least one remote control sends at least a count period select signal.

13. The apparatus according to claim 1, comprising:

a receiver integrated with the ball; and a proximity controller.

14. The apparatus according to claim 13, wherein the proximity controller is capable of sending a signal to the receiver when the ball is within a predetermined distance such that the receiver signal actuates a reset.

15. The apparatus according to claim 1, comprising:

a motion detector integrated with the ball.

16. The apparatus according to claim 15, wherein the motion detector detects motion and actuates a reset on a predetermined motion.

17. The apparatus of claim 1, wherein the at least one predetermined time period comprises a plurality of predetermined time periods and the at least one timer integrated with the ball is for measuring a selected one of the at least one predetermined time periods.

18. An apparatus, comprising:

a ball;

means for measuring at least one predetermined time period;

means for indicating the end of the at least one predetermined time period; and means for resetting the measuring means.

19. The apparatus according to claim 18, comprising:

means for selecting the at least one predetermined time period.

20. The apparatus of claim 18, wherein the at least one predetermined time period comprises a plurality of predetermined time periods and the means for measuring the at least one predetermined time period measures a selected one of the plurality of predetermined time periods.

* * * * *